US005309951A

United States Patent [19]

Steiner

[11] Patent Number: 5,309,951

[45] Date of Patent: May 10, 1994

[54] CONTACT DROP WIRE FOR AN ELECTRIC WARP STOP

[75] Inventor: Ernst Steiner, Richterswil, Switzerland

[73] Assignee: Grob & Co., Horgen, Switzerland

[21] Appl. No.: 897,923

[22] Filed: Jun. 15, 1992

[30] Foreign Application Priority Data

Jun. 13, 1991 [DE] Fed. Rep. of Germany ..... 4119550

[51] Int. Cl.[5] ..... D03D 51/20

[52] U.S. Cl. ..... 139/368

[58] Field of Search ..... 139/351, 353, 368; 28/187, 202

[56] References Cited

U.S. PATENT DOCUMENTS 1,419,077 6/1922 Rhoades ..... 139/368 X 2,834,381 5/1958 Grangler ..... 139/368

3,725,911 4/1973 Cook et al. .

3,907,006 9/1975 Pfarrwaller ..... 139/368 X

FOREIGN PATENT DOCUMENTS 1361816 4/1964 France .

*Primary Examiner*—Andrew M. Falik

*Attorney, Agent, or Firm*—Watson, Cole, Grindle & Watson

[57] ABSTRACT

For a reliable closing of the electric circuit between the inner and outer part of a contact rail on an electric warp stop, a contact drop wire with a chamfered drop wire head is provided, wherein the inner edge of the drop wire head that faces the contact rail slot of the drop wire has at least two sections which are differently chamfered.

5 Claims, 3 Drawing Sheets

CONTACT DROP WIRE FOR AN ELECTRIC WARP STOP

BACKGROUND OF THE INVENTION

The present invention relates to a contact drop wire for an electric warp stop having a chamfered drop wire head.

The contact drop wire for the known electric warp stop is held in a specific position by the warp thread during the weaving operation. If the warp thread tears, the drop wire falls on the contact rail and, due to its shape, closes the electric circuit between the inner and outer part of the contact rail. The current flowing through it serves to turn off the weaving machine. Imperfect fabrics are avoided with these measures.

The shape of the currently widespread contact drop wires is largely internationally standardized. Depending on the system of the drawing-in machines that are used, the angle $\alpha$(see FIG. 1) is fixed at 30° or 37°. This large slope has been fixed a long time ago which assumes that it suffices to reliably and rapidly close the electric circuit between the inner and outer part of the contact rail. However, it has been demonstrated more and more that this requirement is not adequately met. Especially for weaving machines with weft insertion numbers exceeding 600 per minute, the contact does not, with any degree of frequency, effect a shutting down of the weaving machine fast enough. In contrast, experience shows that the drop wire slope does not effect a sufficiently rapid sliding on the contact rail in order to reliably close the electric current. In particular, upon soiling of the warp thread due to the abrasion of the sizing, the sliding of the drop wire and is impeded the transition resistance between the drop wire and contact rail increases.

To remedy this problem, the drop wire could be designed to slide faster on the incline by the provision of a steeper angle so as to also increase the contact pressure with respect to the contact rail. Unfortunately, this solution is not commercially feasible. Most of the larger weaving mills pull in the warp threads automatically and, in particular, also by means of the drop wires. These machines are arranged now in such a manner that the drawing-in means are adapted precisely to the drop wire incline of 37° or 30°. As apparent from FIGS. 2 to 4 of the accompanying drawings, a modification in the angle would change the position of the drop wire. This, however, is not Permissible. Either the drop wire or the automatic drawing-in machine would be damaged. Normally retrofitting the drawing-in machne is not a solution, since othewise the old shapes of drop wire that are in circulation in the hundreds of millions could no longer be manufactured. In particular, drawing-in mills, which work by job orders, would never proceed in such manner.

SUMMARY OF THE INVENTION

Therefore an object of the invention is to provide a contact drop wire with a chamfered drop wire head by means of which the aforementioned drawbacks and problems can be solved.

According to the invention, a contact drop wire for an electic warp stop with a chamfered drop wire head has an inner edge that faces the contact rail slot of the drop wire, with at least two sections or segments which are differently chamfered.

In so doing, at least one of the segments of this inner edge is designed in such a manner that its angle with respect to the longitudinal direction of axis of the drop wire corresponds now as before to the standard slope of 30° or 37°.

Furthermore, the other segment of this inner edge has an incline that is $<30°$, or the angle enclosed between this segment and the longitudinal direction or axis of the drop wire is $<30°$. A preferred enclosed angle is in the range of from 20° to 28°.

DETAILED DESCRIPTION OF THE INVENTION

Figure 1:
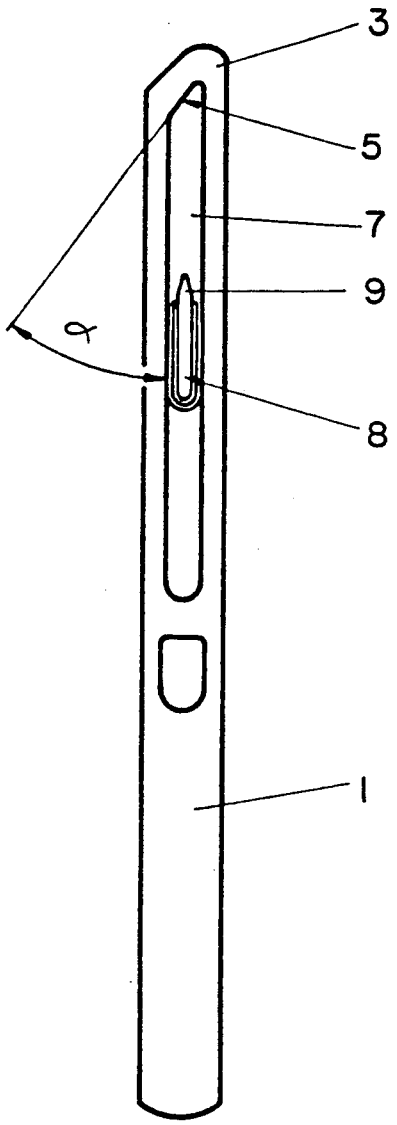
FIG. 1 PRIOR ART
FIG. 1 is a plan view of a currently usable and commercially available contact drop wire with a chamfered drop wire head.

FIG. 1 is longitudinal plan view of a contact drop wire for an electric warp stop The contact drop wire 1 comprises a chamfered drop wire head 3, with an inner edge 5 facing the contact rail slot 7. The contact rail slot 7 has extending therethrough, as shown schematically, a contact rail 8 of the warp stop, the upper inner segment of which is rounded off or substantially pointed as at 9. The angle $\alpha$ enclosed between the longitudinal direction of drop wire 1 and inner edge 5 is normally 30° or 37°, such that the aforedescribed problems can occur if the drop wire head 3 falls on the contact rail point 9 when a warp thread tears.

Figure 2:
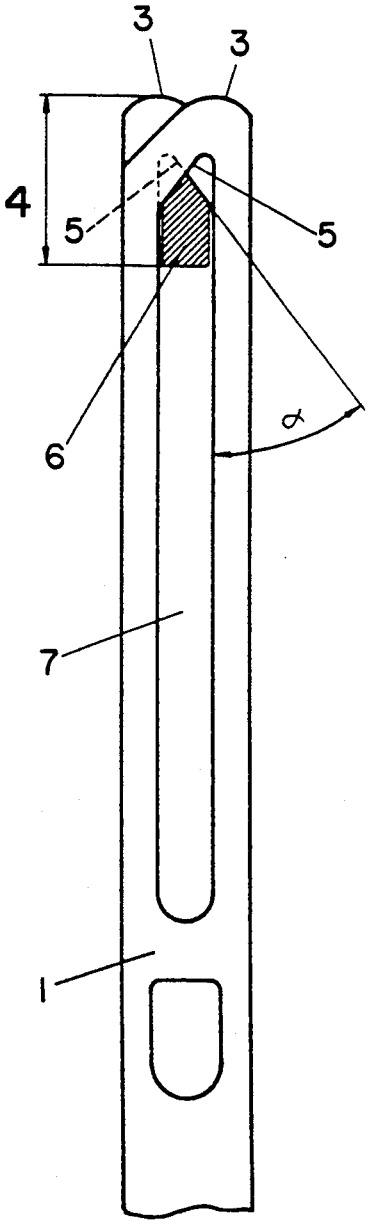
FIG. 2 PRIOR ART
FIGS. 2 to 4 are plan views of three prior art pairs of contact drop wires showing the effect of highly chamfered drop wire heads on the automatic drawing in of warp threads.
Figure 3:
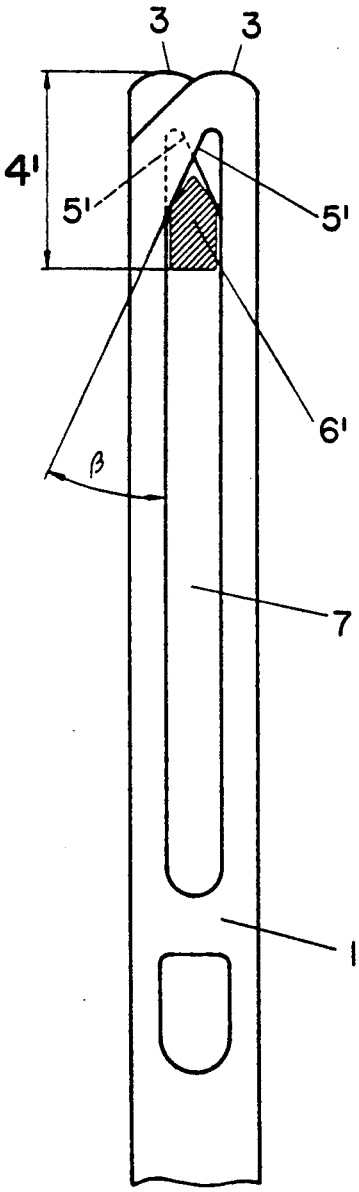
FIG. 3 PRIOR ART
Figure 4:
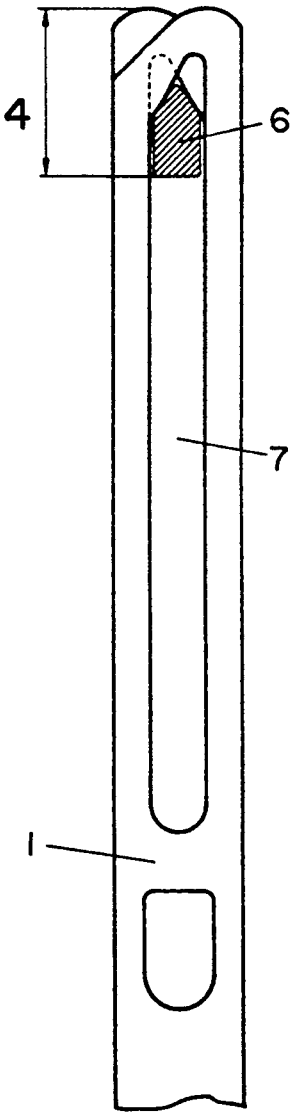
FIG. 4 PRIOR ART

FIGS. 2 and 3 and 4 are schematic drawings of three pairs of contact drop wires 1, where the FIGS. 2 and 4 pairs have a standardized angle $\alpha$ on the inner edge of the drop wire head 3, whereas the FIG. 3 pair has one inner edge 5' at each drop wire head 3, which with the longitudinal direction of the drop wire 1 encloses at an angle $\beta$, which is significantly less than angle $\delta$.

FIGS. 2, 3 and 4 likewise show a part of a drawing-in device 6 or 6', by means of which warp threads can be automatically drawn in. Owing to the different angles $\alpha$ and $\beta$, the FIG. 3 pair of contact drop wires shows that the position of drawing-in device 6' with respect to the drawing-in device 6 (FIG. 2) is shifted into the two outer drop wire pairs 1. This is illustrated by the varying distance 4' from the drop wire head 3 of the FIG. 3 drawing-in device 6' relative to the corresponding distance 4 in the FIGS. 2 and 4 drop wire pairs.

At this stage it is self-evident that during automatic drawing in of the warp threads the FIG. 3, contact drop wire Pair 1 would be damaged. Of course, the drawing-in device 6 or 6' can also be damaged.

Figure 6:
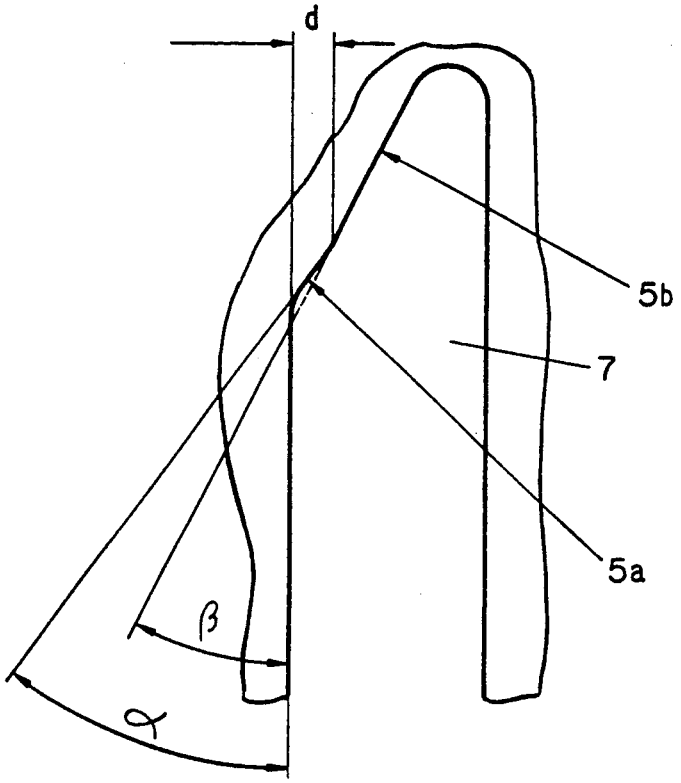
FIG. 6 is a plan view, at a slightly enlarged scale, of the inner edge of the drop wire head of FIG. 5 that faces the drop wire slot.
Figure 5:
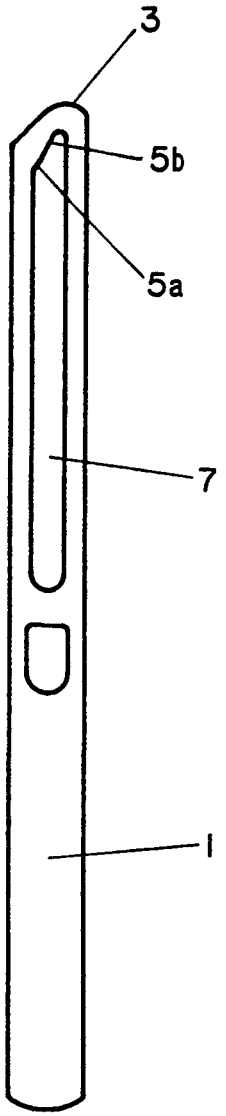
FIG. 5 is a plan view of a contact drop wire designed according to the invention with a chamfered drop wire head and having two differently chamfered sections or segments of the inner edge of the head.

For this reason, the contact drop wire 1, shown in FIG. 5, has been devised according to the invention to avoid the aforementioned drawbacks. The drop wire head 3 of the contact drop wire has an inner edge, facing the contact rail slot 7 with two differently chamfered sections **5*a* and 5*b*. FIG. 6 is an enlarged view of this inner edge, where it is clear that section 5*a* with respect to the longitudinal axis of the drop wire 1 has an enclosed angle , whereas the angle enclosed between section 5***b* and the longitudinal axis of the drop wire 1 is $\beta$. The angle $\alpha$ can have, for example, the standardized angle of 30° or 37°, whereas the angle $\beta$ is $<30°$. The angle $\beta$ can range, for example, from 20° to 28°.

The ratio between the segments 5*a* and 5*b*, or the distance d shown in FIG. 6, depends, for example, on the design of the drawing-in device 6 in order to draw in the warp threads.

In order to make the new drop wire incline, as per section 5*b*, so as to be usable and to assure the reliable and fast shutdown of the machine, the incline is divided into two regions 5*a* and 5*b*, as shown in FIGS. 5 and 6. The bottom section 5*a* remains at the currently worldwide standardized incline of 30° or 37°, whereby a length d of 2 mm maximum is adequate. The remaining section of the incline 5, i.e., section 5*b*, is designed with a steeper angle of 20° to 28° to the longitudinal axis of the drop wire.

This two part incline 5*a* and 5*b* assures not only the usability on manufactured drawing-in machines, but even the mixability of conventional drop wire types with the new improved types. Thus, the weaving mill has the option of using the drop head shape of the invention specifically where its advantages are especially needed, without having to immediately replace all of the existing drop wires. Even in the case of confusion between the two types there need be no fear of damage to the drawing-in machine.

The design of the incline 5 according to FIGS. 5 and 6 can, of course, be modified or varied in keeping with the invention. Thus, of course, it is also possible, depending on the present requirement, to divide this incline into three segments, so that, for example, in the vicinity of the end of the head, following a steeper incline, a segment is provided that is again less steep. Essential to the invention is that the inclined edge 5 have at least two sections, where the one section corresponds to the standarized incline and at least one section is designed significantly steeper than such standarized incline.

What is claimed is:

1. A contact drop wire for an electric warp stop, comprising an elongated body having a logitudinal axis, a chamfered head and a contact rail slot, the head having a sloped inner edge facing the slot whose incline is defined by continuous first and second differently chamfered sections, said first section being oriented at an angle $\beta$ of between 20° and 28° to said longitudinal axis and said second section being oriented at an angle $\alpha$ of 30° to said longitudinal axis.

2. The contact drop wire according to claim 1, wherein said second section is located a greater distance from the drop wire head than said first section.

3. A contact drop wire for an electric warp stop, comprising an elongated body having a longitudinal axis, a chamfered head and a contact rail slot, the head having a sloped inner edge facing the slot whose incline is defined by contiguous first and second differently chamfered sections, said first section being oriented at an angle $\beta$ of less than 30° to said longitudinal axis and said second section being oriented at an angle $\alpha$ of 37° to said longitudinal axis.

4. The contact drop wire according to claim 3, wherein said second section is located a greater distance from the drop wire head than said first section.

5. The contact drop wire according to claim 3, wherein said angle $\beta$ is between 20° and 28°.

* * * * *